US008926401B2

(12) United States Patent
Lemaire et al.

(10) Patent No.: US 8,926,401 B2
(45) Date of Patent: Jan. 6, 2015

(54) METHOD OF SHAPING AN OPHTHALMIC LENS

(75) Inventors: Cédric Lemaire, Charenton le Pont (FR); Romain Batherosse, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 708 days.

(21) Appl. No.: 13/223,401

(22) Filed: Sep. 1, 2011

(65) Prior Publication Data

US 2012/0058714 A1 Mar. 8, 2012

(30) Foreign Application Priority Data

Sep. 7, 2010 (FR) ..... 10 03565

(51) Int. Cl.
*B24B 1/00* (2006.01)
*B24B 9/14* (2006.01)
*B24B 51/00* (2006.01)

(52) U.S. Cl.
CPC .. *B24B 9/14* (2013.01); *B24B 51/00* (2013.01)
USPC ..... 451/43; 451/58

(58) Field of Classification Search
CPC ..... B24B 1/00; B24B 51/00; B24B 9/14; B24B 13/0037; B24B 19/03; B24B 47/225
USPC ..... 451/42, 43, 44, 49, 57, 58
See application file for complete search history.

(56) References Cited

U.S. PATENT DOCUMENTS 5,347,762 A 9/1994 Shibata et al.
6,702,653 B2 3/2004 Shibata
6,758,733 B2 * 7/2004 Wiand ..... 451/461
6,884,154 B2 * 4/2005 Mizushima et al. ..... 451/44
7,410,408 B2 8/2008 Shibata
8,133,095 B2 * 3/2012 Lemaire et al. ..... 451/43
2010/0009603 A1 * 1/2010 Nauche ..... 451/43
2010/0309430 A1 * 12/2010 Haddadi ..... 351/177
2013/0095733 A1 * 4/2013 Lemaire et al. ..... 451/54

FOREIGN PATENT DOCUMENTS

EP 1 266 722 12/2002
EP 1 815 941 8/2007

OTHER PUBLICATIONS

French Search Report dated Jun. 16, 2011, corresponding to the French priority application.

* cited by examiner

*Primary Examiner* — Timothy V Eley
(74) *Attorney, Agent, or Firm* — Young & Thompson

(57) ABSTRACT

A method of shaping an ophthalmic lens for mounting in a mixed surround of an eyeglass frame that presents at least one half-rim, includes:

a) a step of acquiring a longitudinal profile characterizing the shape desired for the outline of the lens;

b) a step of subdividing the longitudinal profile into a first arc associated with the half-rim and a second arc, in which step the positions of two singular points of the longitudinal profile are acquired that characterize the positions of the two ends of the half-rim;

c) a first step of finishing the ophthalmic lens, during which a first portion of its outline is brought to the shape of the first arc; and d) a second step of finishing the ophthalmic lens, during which a second portion of its outline is brought to the shape of the second arc. In step b), the position of at least one of the two acquired singular points is corrected so as to reduce the length of the first arc of the longitudinal profile.

16 Claims, 7 Drawing Sheets

Fig.3C
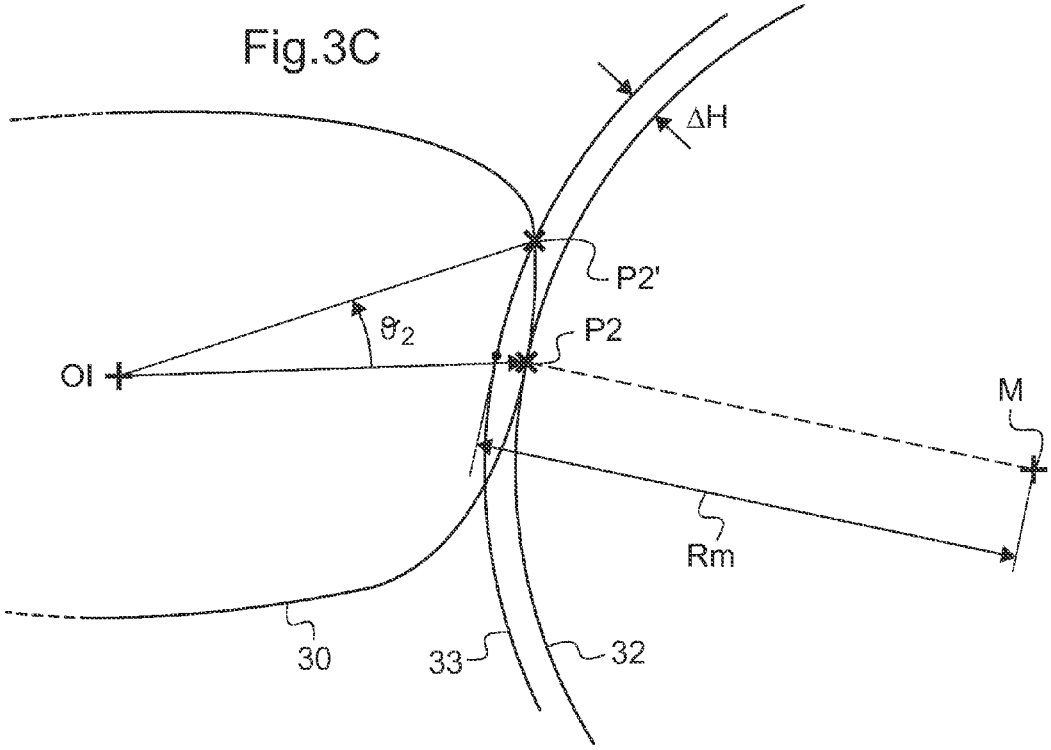
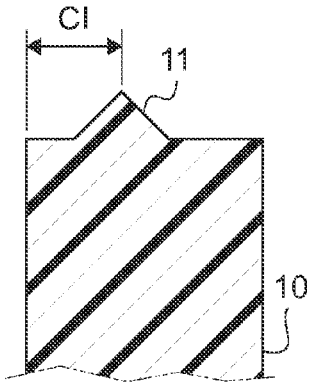
Fig.4A
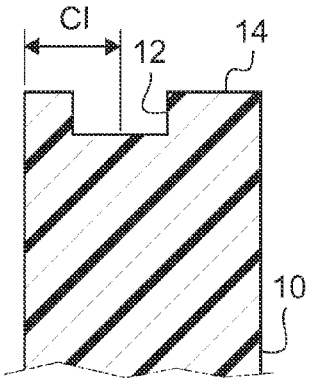
Fig.4B
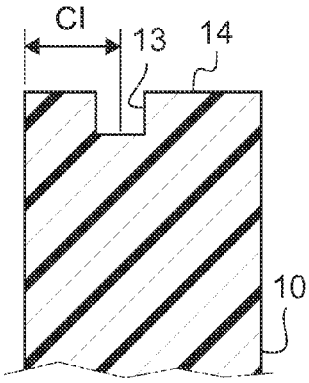
Fig.4C

METHOD OF SHAPING AN OPHTHALMIC LENS

TECHNICAL FIELD TO WHICH THE INVENTION RELATES

The present invention relates in general to preparing ophthalmic lenses for engaging in the surrounds of eyeglass frames.

More particularly, the invention relates to a method of shaping an ophthalmic lens for mounting in a mixed surround of an eyeglass frame.

TECHNOLOGICAL BACKGROUND

The technical portion of the work of an optician consists in mounting a pair of correcting ophthalmic lenses in an eyeglass frame selected by a wearer.

Such mounting comprises three main operations:

acquiring the shape of a longitudinal profile representative of the shape of the outline of one of the surrounds of the selected eyeglass frame;

centering the ophthalmic lens in question, which operation consists in positioning and orienting said longitudinal profile appropriately on the lens so that once the lens has been machined to have this profile and has been mounted in the frame, it is positioned and oriented correctly relative to the corresponding eye of the wearer, thereby performing as well as possible the optical function for which it is designed; and then shaping the lens, which operation includes a roughing step to bring its initially circular outline to a shape that is close to the desired shape, a finishing step, and a superfinishing step (polishing, beveling, . . . ).

For half-rimmed eyeglass frames, the surround comprises a half-rim that fits over a top portion of the outline of the lens and a nylon string that runs along the bottom portion of the outline of the lens in order to hold the lens in contact with the half-rim. The finishing step then generally consists in grooving the edge face of the lens so as to form an engagement groove suitable for receiving not only the nylon string, but also a ridge provided along the inside face of the half-rim.

It is sometimes found that, once assembled, such half-rimmed eyeglass frames are not completely rigid and there is a risk of one or other of the lenses disengaging from the eyeglass frame. To mitigate that lack of rigidity, document EP 1 266 722 discloses a method of shaping an ophthalmic lens in which the finishing step includes a first grooving operation performed in a top portion of the outline of the lens, and a second grooving operation performed in a bottom portion of the outline of the lens to a different depth, thereby retaining the nylon string better.

At present, other types of eyeglass frames having mixed surrounds are appearing on the market.

For example, eyeglass frames are known in which each surround includes an interruption. The step of finishing the lens then comprises a first operation of beveling a major portion of the outline of the lens, and a second operation of leveling the edge face of the lens using a circularly cylindrical grindwheel in the interruption of the surround.

Half-rimmed eyeglass frames are also known that are unusual in which the inside face of each half-rim does not include a ridge, but rather an engagement groove. The step of finishing the lens, as described in document EP 1 266 722 then includes a first operation of beveling a top portion of the outline of the lens, followed by an operation of grooving a bottom portion of the outline of the lens.

The major drawback of those shaping methods, in which the finishing steps comprise two distinct operations, is that the boundaries between the two portions of the outline of the lens form unsightly discontinuities, since they can be seen at the ends of the half-rim (or of the interrupted surround).

For the above-described unusual half-rimmed eyeglasses, those discontinuities also present problems with holding the lens in its surround.

OBJECT AND SUMMARY OF THE INVENTION

In order to remedy the above-mentioned drawbacks, the present invention provides a method of shaping an ophthalmic lens, the method comprising:

a) a step of acquiring a longitudinal profile characterizing the shape desired for the outline of said ophthalmic lens;

b) a step of subdividing said longitudinal profile into a final first arc associated with a first segment of the mixed surround and a second arc distinct from said final first arc, in which step the positions of two initial singular points of the longitudinal profile are acquired that characterize the positions of the two ends of the first segment of said mixed surround;

c) a first finishing step of finishing the ophthalmic lens, during which a first portion of its outline is brought to the shape of the final first arc of said longitudinal profile; and d) a second finishing step of finishing the ophthalmic lens during which a second portion of its outline is brought to the shape of the second arc of said longitudinal profile;

said first and second finishing steps being performed in such a manner that the edge face of the ophthalmic lens presents transverse profiles of shapes that are different over the first and second portions of the outline of the ophthalmic lens;

wherein, in step b), the position of at least one of the two initial singular points is corrected in such a manner as to obtain two final singular points that define said final first arc, which arc is truncated so that its length is shorter than that of an initial first arc of the longitudinal profile extending between the two initial singular points in order to reduce the length of the longitudinal profile.

Thus, since the length of the final first arc is shortened, the boundaries between the two finishes are no longer positioned at the ends of the first segment of the surround (typically the half-rim), but they lie under said first segment.

By means of the invention, the discontinuities that are situated at the boundaries between the two portions of the outline of the lens are thus hidden under the first segment of the surround, thereby improving the appearance of the pair of eyeglasses.

Furthermore, with the above-mentioned unusual half-rimmed eyeglass frames, since the groove begins under the ends of the half-rim, the nylon string can engage directly in the groove without coming into abutment against the engagement ridge, thereby improving the rigidity of the assembly.

The shaping method in accordance with the invention presents other characteristics that are advantageous and non-limiting, as follows:

for said longitudinal profile presenting a boxing center, the two acquired singular points are angularly spaced apart around the boxing center by an initial angle that is equal to the angle between the two ends of the first segment about the boxing center;

the two corrected singular points are angularly spaced apart about the boxing center by a final angle that is at least 5 degrees smaller than said initial angle;

in step b), the position of at least one of the two acquired singular points is corrected in order to obtain the corresponding singular point by an offset calculated as a function of the shape of said longitudinal profile;

for step c) and step d) being implemented respectively using first and second finishing tools, in step b), the position of at least one of the two acquired singular points is corrected in order to obtain the corresponding corrected singular point by an offset that is calculated as a function of the shape of at least one of said first and second finishing tools;

in step b), the position of at least one of the two acquired singular points is corrected by a predetermined offset in order to obtain the corresponding corrected singular point;

in step c), the entire outline of the ophthalmic lens is machined using a first finishing tool, and, in step d), only a portion of the outline of the ophthalmic lens is machined using a second finishing tool;

in step c), the first portion of the outline of the ophthalmic lens is beveled using a beveling tool, and, in step d), the second portion of the outline of the ophthalmic lens is leveled using a straight leveling tool and then grooved using a grooving tool;

in step c), the ophthalmic lens is beveled in a link portion situated between said first and second portions of the outline of the ophthalmic lens along a link arc that extends from the final first arc of said longitudinal profile and that is offset radially outwards from the longitudinal profile;

for said beveling tool presenting a beveling groove, said link arc is offset from said longitudinal profile by a maximum offset equal to the depth of said beveling groove;

the bevel made in step c) is pared away and then grooved along all of said link portion of the outline of the ophthalmic lens;

in step c), the first portion of the outline of the ophthalmic lens is beveled using a beveling tool, and, in step d), the second portion of the outline of the ophthalmic lens is only leveled using a straight leveling tool;

the ophthalmic lens is beveled in a link portion situated between said first and second portions of the outline of the ophthalmic lens along a link arc that extends from the final first arc of said longitudinal profile and that is offset radially to the outside of the longitudinal profile by a maximum offset that is less than or equal to the depth of a beveling groove provided in said beveling tool;

for the second arc being complementary to the final first arc, the ophthalmic lens is beveled over the first portion of its outline along said final first arc and is leveled over the second portion of its outline along the second arc;

in step c), the first portion of the outline of the ophthalmic lens is grooved so as to form a first groove, and, in step d), the second portion of the outline of the ophthalmic lens is grooved so as to form a second groove of width and/or depth that is different from the width and/or depth of said first groove; and said first and second grooves are made using the same grooving tool.

DETAILED DESCRIPTION OF AN EMBODIMENT

The following description with reference to the accompanying drawings given by way of non-limiting example explains what the invention consists in and how it can be reduced to practice.

In the accompanying drawings:

FIG. 3C is a diagrammatic plan view of the longitudinal profile of FIG. 3A and of the profile of a shaper grindwheel;

FIGS. 4A to 4C are diagrammatic cross-section views of three ophthalmic lenses, that are respectively beveled, grooved over a large width, and grooved over a narrow width;

The present invention relates to a method of shaping an ophthalmic lens in order to mount it in a surround of an eyeglass frame having mixed surrounds.

The term "eyeglass frame having mixed surrounds" is used to mean any frame in which each surround comprises an interrupted segment or two distinct segments (i.e. two segments that are fitted with lens-securing means that present different architectures).

In the present description, attention is given to three particular types of eyeglass frame having mixed surrounds.

The two first types of eyeglass frames are half-rimmed frames.

Figure 3A:
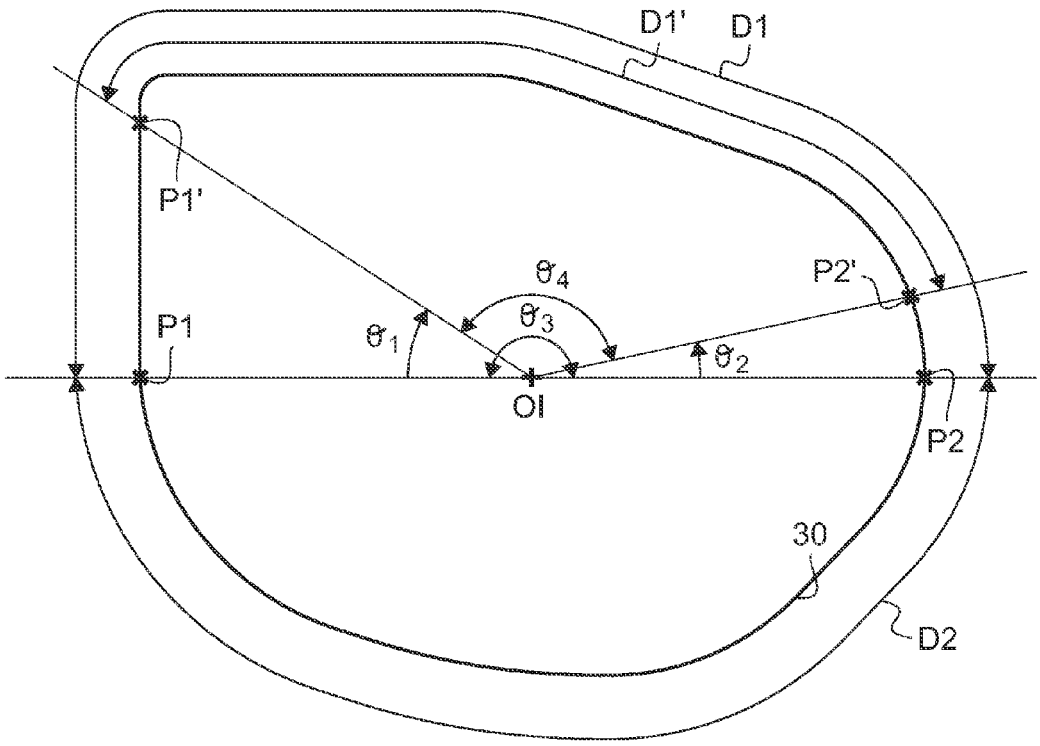
FIG. 3A is a diagrammatic plan view of a longitudinal profile of a surround of an eyeglass frame.
Figure 3B:
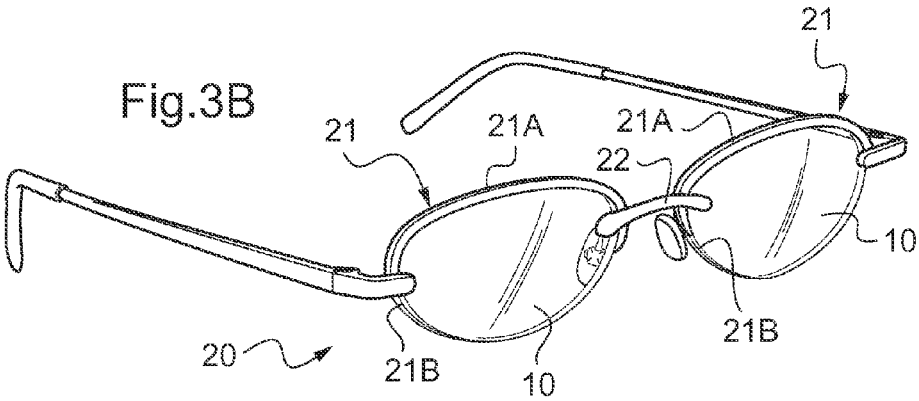
FIG. 3B is a diagrammatic perspective view of a pair of eyeglasses.

As shown in FIG. 3B such a half-rimmed eyeglass frame 20 has two surrounds 21, each comprising a half-rim 21A (the first segment) that is applied against the top portion of the outline of the ophthalmic lens 10, and a nylon string 21B (the second segment) that runs along a bottom portion of the outline of the same lens in order of hold it pressed against the half-rim 21A.

The first type of eyeglass frame, the most conventional, includes on the inside face of each of its half-rim 21A, a respective engagement ridge arranged to engage in a groove provided in the edge face of the corresponding ophthalmic lens 10.

The shaping of the ophthalmic lens 10 then preferably includes a grooving step during which two grooves of different widths are formed in the edge face of the lens, one matching the dimensions of the engagement ridge, and the other matching the diameter of the nylon string.

The second type of eyeglass frame is less common, and includes, in the inside face of each of its half-rims 21A, an engagement groove (or "bezel") in which it is possible to engage a ridge (or "bevel") provided on the edge face of the corresponding ophthalmic lens 10.

The shaping of the ophthalmic lens 10 then includes a step of beveling a top portion of its outline, followed by a step of grooving a bottom portion of its outline.

The third type of eyeglass frame to which attention is given in this description has two surrounds each presenting an interruption, each surround then including only one part-rim (the first segment).

An ophthalmic lens for mounting in such a frame is then beveled over a major portion of its outline and leveled over a remaining fraction of its outline (the portion left visible by the interruption) so as to present a "plane" edge face over said portion of its outline.

Device

For implementing the method of the invention, use may be made of a shaper appliance made in the form of any machine for cutting away or removing material and suitable for modifying the outline of an ophthalmic lens in order to fit it to the outline of the surround of the selected frame.

Figure 1:
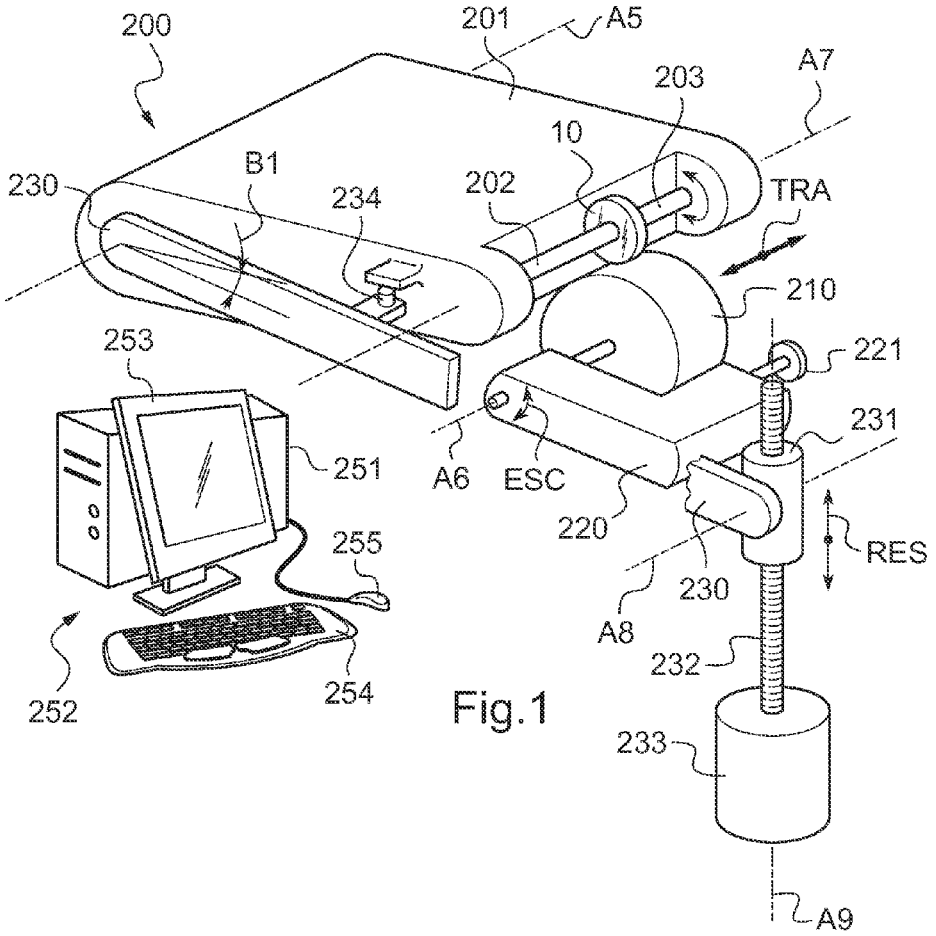
FIG. 1 is a diagrammatic perspective view of a shaper appliance adapted to implement a shaping method of the invention.

In the example shown diagrammatically in FIG. 1, the shaper appliance is constituted in known manner by an automatic grinder 200, commonly said to be numerically-controlled. Specifically, the grinder comprises:

- a rocker 201 that is mounted to pivot freely about a reference axis A5, in practice a horizontal axis, on a structure (not shown) and supporting the ophthalmic lens 10 for machining;
- a grindwheel set 210 that is constrained to rotate on a grindwheel axis A6 parallel to the reference axis A5, and that is likewise duly driven in rotation by a motor (not shown); and
- a finishing module 220 that is mounted to pivot about the grindwheel axis A6 and that carries a grooving grindwheel 221 for grooving the ophthalmic lens 10.

The rocker 201 is fitted with a lens support, here constituted by two shafts 202 and 203 for clamping and turning the ophthalmic lens 10 that is to be machined.

These two shafts 202 and 203 are in alignment with each other along a blocking axis A7 parallel to the axis A5. Each of the shafts 202, 203 possesses a free end facing the other shaft and fitted with a blocking chuck for blocking the ophthalmic lens 10.

A first one of the two shafts 202 is stationary in translation along the blocking axis A7, in contrast, the second one of the two shafts 203 is movable in translation along the blocking axis A7 to apply axial compression for clamping the ophthalmic lens 10 between the two blocking chucks.

Figure 2:
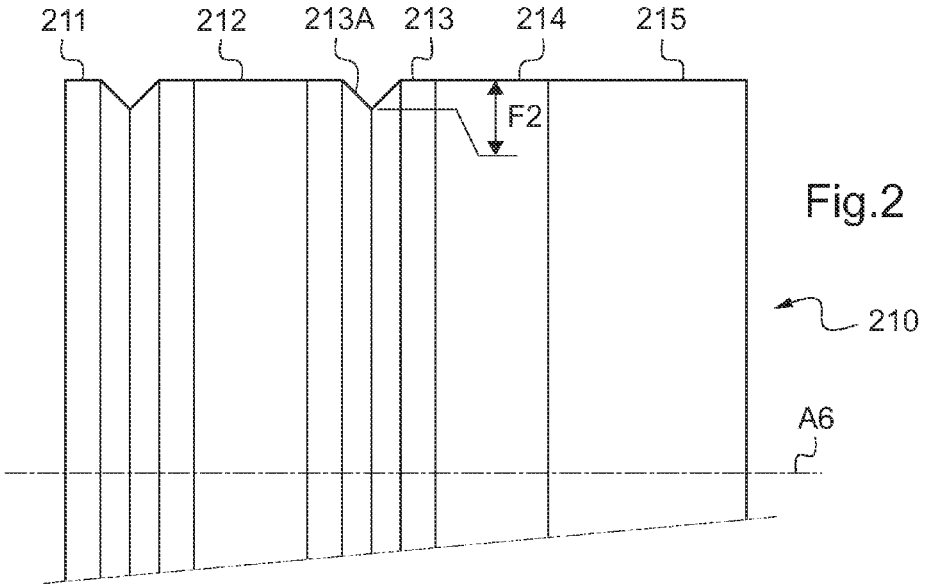
FIG. 2 is a diagrammatic plan view of the set of grindwheels of the shaper appliance of FIG. 1.

As shown diagrammatically in FIG. 2, the set of grindwheels 210 comprises a plurality of grindwheels mounted on the grindwheel axis A6, each grindwheel being used for a specific machining operation of the ophthalmic lens 10 for machining.

In particular, the set of grindwheels 210 comprises:

- a cylindrical roughing grindwheel 215 forming a body of revolution about the grindwheel axis A6, presenting a diameter of 155 millimeters, and having a coarse grain;
- a straight cylindrical leveling grindwheel 214 constituting a body of revolution about the grindwheel axis A6, presenting a diameter of 155 millimeters, and having an intermediate grain;
- a beveling grindwheel 213 that is substantially identical to the straight leveling grindwheel 214 but that presents a beveling groove 214A halfway along, which groove is of triangular cross-section; and
- two polishing grindwheels 211 and 212 of shapes identical to the straight leveling grindwheel 214 and the beveling grindwheel 213, but having a fine grain.

The roughing grindwheel 215 is thus a roughing tool for rough machining of the ophthalmic lens. The straight leveling grindwheel 214 and the beveling grindwheel 213 are finishing tools for machining the edge face of the ophthalmic lens so that it presents a particular transverse profile adapted to the shape of the surround of the selected eyeglass frame. The polishing grindwheels 211 and 212 are super-finishing tools arranged to modify the surface state of the edge face of the ophthalmic lens.

The set of grindwheels 210 is carried by a carriage (not shown) mounted to move in translation along the grindwheel axis A6. The movement in translation of the grindwheel carriage is referred to as "transfer" and referenced TRA.

It can be understood that this serves to cause the grindwheels to move relative to the lens, but that in a variant it is possible for the lens to be moved axially while the grindwheels remain in a fixed position.

The grinder 200 also includes a link 230 having one end hinged relative to the structure to pivot about the reference axis A5 and having its other end hinged relative to a nut 231 in order to pivot about an axis A8 that is parallel to the reference axis A5.

The nut 231 is itself mounted to move in translation along a reproduction axis A9 perpendicular to the reference axis A5. The nut 231 is a tapped nut in screw engagement on a threaded rod 232 that extends along the reproduction axis A9 and that is driven in rotation by a motor 233.

The link 230 also includes a contact sensor 234, e.g. constituted by a Hall effect cell, that interacts with a corresponding element of the rocker 201. The pivot angle of the link 230 about the reference axis A5 and relative to the horizontal is referenced B1. This angle B1 is linearly associated with the movement in vertical translation of the nut 231 along the reproduction axis A9, itself referenced RES.

The finishing module 220 is movable in pivoting about the grindwheel axis A6, referred to as retraction movement ESC. Specifically, the finishing module 220 is provided with a toothed wheel (not shown) that meshes with a gearwheel fitted to the shaft of an electric motor secured to the grindwheel carriage. This freedom of movement enables it to approach or to move away from the ophthalmic lens 10.

The grooving grindwheel 221 carried by the finishing module 220 is here in the form of a disk having its axis of rotation parallel to the grindwheel axis A6. Its thickness is small, about one millimeter, for the purpose of making grooves of narrow width in the edge face of the ophthalmic lens 10. This grooving grindwheel 221 thus forms the third finishing tool of the grinder 200.

When the ophthalmic lens 10 that is to be machined is duly clamped between the two shafts 202 and 203, and is brought into contact with one of the grindwheels of the set of grindwheels 210, material is indeed removed therefrom until the rocker 201 comes into abutment against the link 230 via the contact sensor 234, thereby enabling it to detect the abutment.

In order to machine the ophthalmic lens 10 with a given outline, it thus suffices firstly to move the nut 231 appropriately along the reproduction axis A9 under the control of the motor 233 in order to control the reproduction movement RES, and secondly to cause the support shafts 202 and 203 to move together about the blocking axis A7. The reproduction movement of the rocker 201 and the turning movement of the shafts 202 and 203 are controlled in coordinated manner by a control unit 251 that is suitably programmed for this purpose so that all of the points of the outline of the ophthalmic lens 10 are brought in succession to the appropriate diameter.

The control unit 251 is of the electronic and/or computer type and it serves in particular to control the following:

- the motor for driving the second shaft 203 in translation;
- the motor for turning both shafts 202 and 203;
- the motor for driving the grindwheel carriage in translation along the transferred direction TRA;

the motor 233 driving the nut 231 in translation along the reproduction direction RES;

the motor for pivoting the finishing module 220 through a retraction angle ESC; and the motor for driving the grooving grindwheel 221 in rotation.

Finally, the grinder 200 includes a man-machine interface 252, here comprising a display screen 253, a keyboard 254, and a pointer device 255 (here a mouse) adapted to communicate with the control unit 251. This man-machine interface 252 enables the user to input digital values via the display screen 253 in order to control the grinder 200 accordingly.

As shown in FIG. 1, the control unit is implemented by means of an office computer connected to the grinder 200. Naturally, in a variant, the software portion of the grinder could be implemented directly in an electronic circuit of the grinder. It could equally well be implemented on a remote computer, communicating with the grinder over a private or public network, e.g. communicating by using Internet protocol (IP).

The method of shaping the ophthalmic lens 10 in order to mount it in the surround of one of the above-mentioned eyeglass frames comprises a plurality of successive steps.

First Step

During a first step, the control unit 251 acquires the three-dimensional shape of a longitudinal profile 30 (see FIG. 3A) illustrating the shape that the outline of the ophthalmic lens 10 ought ideally to present in order to enable it to fit properly in the corresponding surround of the selected eyeglass frame.

This longitudinal profile 30 may for example be acquired in the form of a set of triplets, the triplets corresponding to the coordinates of a plurality of points characterizing the shape of the longitudinal profile 30.

Preferably, the longitudinal profile 30 is acquired in a database registry made available to the optician. The database registry is regularly updated by the eyeglass frame manufacturer or by the ophthalmic lens manufacturer or indeed by the optician personally, and for this purpose it includes a plurality of records, each associated with a model of eyeglass frame. Each record then includes an identifier of the eyeglass frame model with which it is associated, and a set of 360 triplets that are characteristic of the shape of the longitudinal profile of each surround of that eyeglass frame model.

In a variant, the longitudinal profile 30 may be acquired using an imaging device having image capture means and image processor means. By using the imaging device, the coordinates of points characterizing the longitudinal profile 30 may be acquired by taking a photograph of a presentation lens delivered with the eyeglass frame, and then processing the photograph so as to identify on the photograph 360 points that are situated on the edge face.

The three-dimensional shape of the longitudinal profile 30 may equally well be acquired in some other way, for example by tracing, i.e. by making contact with the edge face of the presentation lens with a tracer.

Second Step

During a second step, the control unit 251 acquires the coordinates of two initial singular points P1 and P2 of the longitudinal profile 30.

These two initial singular points P1 and P2 correspond to the points that, once the pair of eyeglasses has been assembled, are situated at the ends of a half-rim (if the frame is half-rimmed) or at the ends of the interruption in the surround (if the frame is of the third type).

The coordinates of these two initial singular points P1 and P2 may be acquired in various ways.

Preferably, they may be acquired by providing for each record in the above-mentioned database registry to include two additional triplets corresponding to the coordinates of the two initial singular points P1 and P2 of the surround of the eyeglass frame model with which the record is associated. Thus, the longitudinal profile 30 and acquiring its two initial singular points P1 and P2 are acquired simultaneously by means of a single search in the registry for a record corresponding to the selected eyeglass frame.

In a variant, provision may be made for the positions of the two initial singular points P1 and P2 along the longitudinal profile 30 to be acquired freehand by the optician.

For this purpose, after acquiring the three-dimensional shape of the longitudinal profile 30, the control unit 251 may cause said longitudinal profile 30 to be displayed on the display screen 253. In this way, the optician can then use the pointer device 255 to point at the two initial singular points P1 and P2 on the longitudinal profile 30.

Under such circumstances, it is advantageous for the longitudinal profile 30 to be displayed on the screen at a 1:1 scale so that the optician can position the eyeglass frame or the presentation lens in front of the display screen 253 in register with the displayed longitudinal profile 30 in order to identify accurately the positions of the two initial singular points P1 and P2 along the initial profile 30.

Consequently, the two initial singular points P1 and P2 are angularly spaced apart about the boxing center O1 of the longitudinal profile 30 by an initial angle THETA3 that is equal to the angle between the two ends of the half-rim 21A about the boxing center of the surround 21.

For this purpose, and in conventional manner, it should be recalled that the boxing center is defined as being the center of the rectangle that circumscribes the longitudinal profile or the surround and that has two sides parallel to the horizontal.

As shown in FIG. 3A, when the positions of the two initial singular points P1 and P2 have been acquired, the control unit 10 subdivides the longitudinal profile 30 into two initial arcs D1 and D2 that are complementary and situated on opposite sides of the two initial singular points P1 and P2.

An initial first arc D1, also referred to as the initial top arc D1, corresponds to the portion of the longitudinal profile 30 that is situated at the height of the half-rim 21A, while the second initial arc D2, also referred to as the second arc or the lower arc D2, corresponds to the portion of the longitudinal profile 30 that is situated at the height of the nylon string 21B.

Third Step

During a third step, as shown in FIG. 3A, the control unit 251 corrects the position of at least one of the two initial singular points P1 and P2 to obtain two respective final singular points P1' and P2' that are set back in from the initial singular points P1 and P2. These final singular points P1' and P2' then define a final first arc D1', also referred to as the final top arc D1', constituting a truncated correction of the initial top arc Dl: the length of this final top arc D1' is shorter than the length of the initial top arc D1 of the longitudinal profile 30.

Because of this reduction in length, the boundary between the two finishes to be provided on the edge face of the lens (bevel, grooved or level finishing) is brought under the half-rim 21A so that the transition is not visible.

When the position of only one of the two initial singular points P1 and P2 is selected, then the initial singular point P2 that is selected for correction is the point situated beside the temporal portion of the longitudinal profile 30. Beside the nose, the transition between the two finishes is generally hidden by the nose pads of the eyeglass frame.

Nevertheless, the control unit 251 in this example corrects the positions of both initial singular points P1 and P2.

In order to correct the positions of the two initial singular points P1 and P2, and thereby obtain the final singular points P1' and P2', the control unit 251 proceeds to offset these two points by respective given offsets. These offsets may be expressed in the form of length along the curvilinear abscissa of the longitudinal profile. They may also be expressed, as can be seen in FIG. 3A, in the form of respective offset angles THETA1 and THETA2 about the boxing center O1 of the longitudinal profile 30.

As shown in FIG. 3A, this correction then consists in determining the points of the longitudinal profile 30, referred to as the final singular points P1' and P2', that are offset angularly from the two initial points P1 and P2 by respective first and second offset angles THETA1 and THETA2.

These first and second offset angles THETA1 and THETA2 are preferably greater than or equal to 5 degrees, such that the two final singular points P1' and P2' are angularly offset about the boxing center O1 by a final angle THETA4 that is less than said initial angle THETA3 by at least 10 degrees.

The offset angles THETA1 and THETA2 may be predetermined, and thus invariable, regardless of the shape of the selected eyeglass frame 20.

Nevertheless, in this example, these offset angles THETA1 and THETA2 are calculated as a function not only of the shape of the longitudinal profile 30, but also as a function of the radii of the finishing tools 213, 214, and 221 that are selected for machining the lens.

These offset angles THETA1 and THETA2 are calculated while taking account of phenomena whereby the bevel 11 of the ophthalmic lens 10 becomes pared away.

This phenomenon, referred to as "paring-away of the bevel" can be explained as follows. The beveling grindwheel 213 presents a large radius. As a result, during the beveling operation, the angular fraction of the beveling grindwheel that is engaged in the material of the lens is considerable. Consequently, while the beveling grindwheel is machining the edge face of the lens so as to obtain a given cross-section for said lens, it also, involuntarily, machines a portion of the edge face of the lens that is situated ahead of said cross-section and another portion of the edge face of the lens that is situated behind said cross-section. First interference is then observed between the beveling grindwheel and the portion of the bevel that has already been made, and second interference is observed between the beveling grindwheel and the portion of the bevel that remains to be made. This interference thus gives rise to this phenomenon of the bevel being thinned.

The way the offset angles THETA1 and THETA2 are calculated can then take this interference into account so as to position the corrected singular points P1' and P2' as well as possible on the longitudinal profile 30.

An example of a method for determining these offset angles THETA1 and THETA2 is shown in FIG. 3C.

This figure shows the longitudinal profile 30 together with the inner and outer profiles 32 and 33 of the grindwheel used for shaping the ophthalmic lens (typically the beveling grindwheel 213 or the grooving grindwheel 221). If it is the beveling grindwheel 213, then the outer profile 33 corresponds to the general profile of the grindwheel, while the inner profile 32 corresponds to the profile of the bottom of the beveling groove in said grindwheel. If it is the grooving grindwheel 221, then the outer profile 33 corresponds to the general profile of the grooving grindwheel, while the inner profile 32 corresponds to the profile of the non-active portion of said grindwheel (i.e. the portion that does not contribute to machining the lens, given the depth to which the grindwheel penetrates into the edge face of the lens).

In FIG. 3C, the radius of the outer profile 33 is written $R_m$, while the offset between the inner and outer profiles 32 and 33 is written ΔP.

The method of determining the offset angle THETA2 then consists in:

determining the positions of the grindwheel profiles 32 and 33 relative to the longitudinal profile 30 when the grindwheel is correctly positioned for machining the ophthalmic lens at the initial singular point P2 (i.e. when the grindwheel is tangential to the longitudinal profile 30 at the initial singular point P2); and then in determining the angle (about the boxing center O1) between the initial singular point P2 and the point of intersection between the outer profile 33 and the longitudinal profile 30.

In this method, this point of intersection also corresponds to the final singular point P2'.

As shown in FIG. 3A, when the positions of the two final singular points P1' and P2' are known, the control unit 10 defines a final first arc D1', referred to in this example as the final top arc, corresponding to the portion of the longitudinal profile 30 that is defined between these two final singular points P1' and P2'. This final top arc D1' presents a length that is shorter than that of the initial top arc D1.

The bottom arc D2 remains defined as being the arc extending between the two initial singular points P1 and P2, such that the final top arc D1' and the bottom arc D2 are no longer complementary.

Fourth Step

During a fourth step, referred to as a "roughing" step, the control unit 251 controls the various degrees of freedom of the grinder 200 in such a manner as to reduce approximately to size the radii of the ophthalmic lens 10 as previously blocked between the clamping shafts 202 and 203 of the grinder 200.

The roughing grindwheel 215 and the rocker 201 are controlled to move relative to each other for this purpose in such a manner as to reduce the radius of the lens in each angular position of the lens about the blocking axis A7 so that it becomes a radius that is strictly greater than the radius corresponding to the longitudinal profile 30.

Fifth and Sixth Steps

During a fifth step, referred to as the first finishing step, the control unit 251 controls the various degrees of freedom of the grinder 200 in such a manner as to bring a top portion E1 (see FIG. 9) of the outline of the lens to the shape of the final first arc D1' of the longitudinal profile 30.

During a sixth step, referred to as the second finishing step, the control unit 251 controls the various degrees of freedom of the grinder 200 so as to bring a bottom portion E2 of the outline of the lens to the shape of the second arc D2 of the longitudinal profile 30.

These first and second finishing steps are performed so that the finishes (bevel 11, groove 12-13, level finish 14) are different on the two portions E1 and E2 of the outline of the ophthalmic lens 10.

Advantageously, the first finishing step is performed over the entire outline of the ophthalmic lens, while the second finishing step is performed over only a portion of the outline of the lens, the portion that is complementary to the top portion E1.

As shown in FIGS. 4A to 4C, these finishes 11, 12, and 13 are preferably provided in such a manner that their mean lines extend at a common constant distance C1 from the front face of the ophthalmic lens 10.

During a seventh and last step, the edge face of the ophthalmic lens 10 is polished using the polishing grindwheels 211 and 212 of the grinder 200.

In the description below, three implementations of the two finishing steps are described in detail, for shaping three ophthalmic lenses for mounting on eyeglass frames respectively of the first type, of the second type, and of the third type.

FIRST EXAMPLE

Consideration is given initially to the selected eyeglass frame being of the second type.

Figure 10:
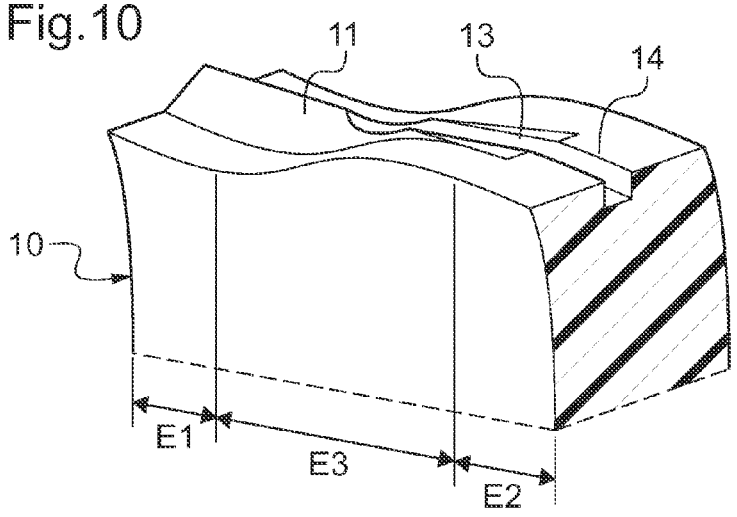

As shown in FIG. 10, the first finishing step then needs to consist in an operation of beveling the top portion E1 of the outline of the ophthalmic lens 10, while the second finishing step needs to consist in two operations of leveling and of grooving the bottom portion E2 of the outline of the ophthalmic lens 10.

With reference to FIG. 3A, provision could be made to bevel only the top portion E1 of the outline of the ophthalmic lens 10 between the two final singular points P1' and P2', and then to level and groove the remaining portion of the outline of the ophthalmic lens 10, following the longitudinal profile 30.

Figure 5:
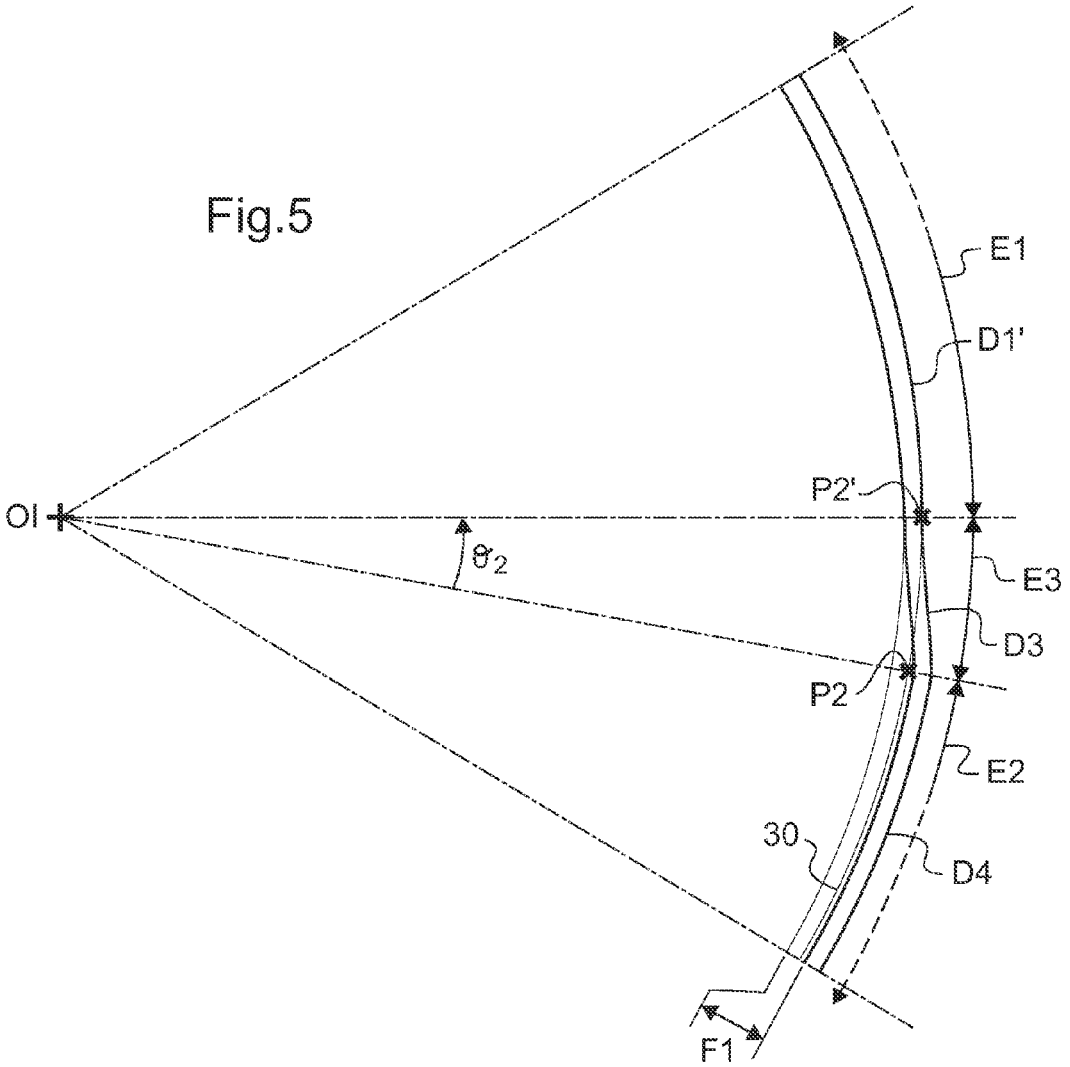
FIGS. 5 and 6 are diagrammatic plan and perspective views of a peripheral portion of a beveled ophthalmic lens.
Figure 6:
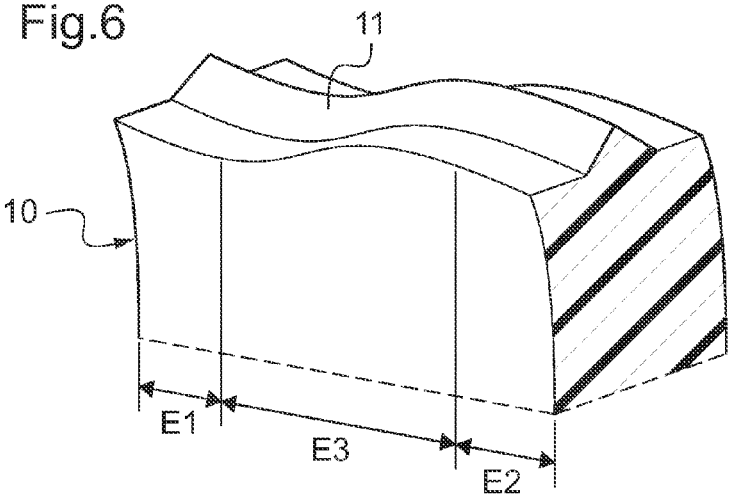

Nevertheless, in this example, and as shown more precisely in FIGS. 5 and 6, during the first finishing step the entire outline of the ophthalmic lens 10 is beveled to have a profile made up of arcs D1'-D3-D4, part of the profile being different from the longitudinal profile 30.

During this beveling operation, the beveling grindwheel 213 is controlled relative to the ophthalmic lens 10 more particularly in such a manner that the bottom of its beveling groove 213A follows a profile that coincides with the final top arc D1' of the longitudinal profile 30, but that is different from the bottom arc D2.

The bottom portion E2 of the outline of the ophthalmic lens 10, situated between the two initial singular points P1 and P2 is then beveled to have an arc referenced D4 that is different from the bottom arc D2 of the longitudinal profile 30 but that extends over the same angular sector.

This arc D4 differs from the bottom arc D2 in that it is spaced apart radially therefrom around the boxing center O1 by a constant offset F1. This offset F1 is selected to be equal to the depth F2 of the beveling groove 213A of the beveling grindwheel (FIG. 2).

As shown in FIG. 5, between the top and bottom portions E1 and E2 of its outline, i.e. between each initial singular point P1 and P2 and the corresponding final singular point P1' and P2', the ophthalmic lens 10 is beveled to have a link arc D3 that extends from the final top arc D1' to the arc D4, thus being radially offset from the longitudinal profile 30.

As shown in FIG. 6, in this link portion E3, the outline of the ophthalmic lens 10 thus forms a rounded step that is progressive and continuous, of curvilinear abscissa length that is associated with the value of the offset angle THETA1 or THETA2, and of height that is equal to the depth F2 of the beveling groove 213A of the beveling grindwheel 213.

During the second finishing step, only a fraction of the outline of the ophthalmic lens 10 is leveled and then grooved. This fraction of the outline of the lens comprises the bottom portion E2 and the two link portions E3 lying at opposite ends of the bottom portion E2.

Figure 7:
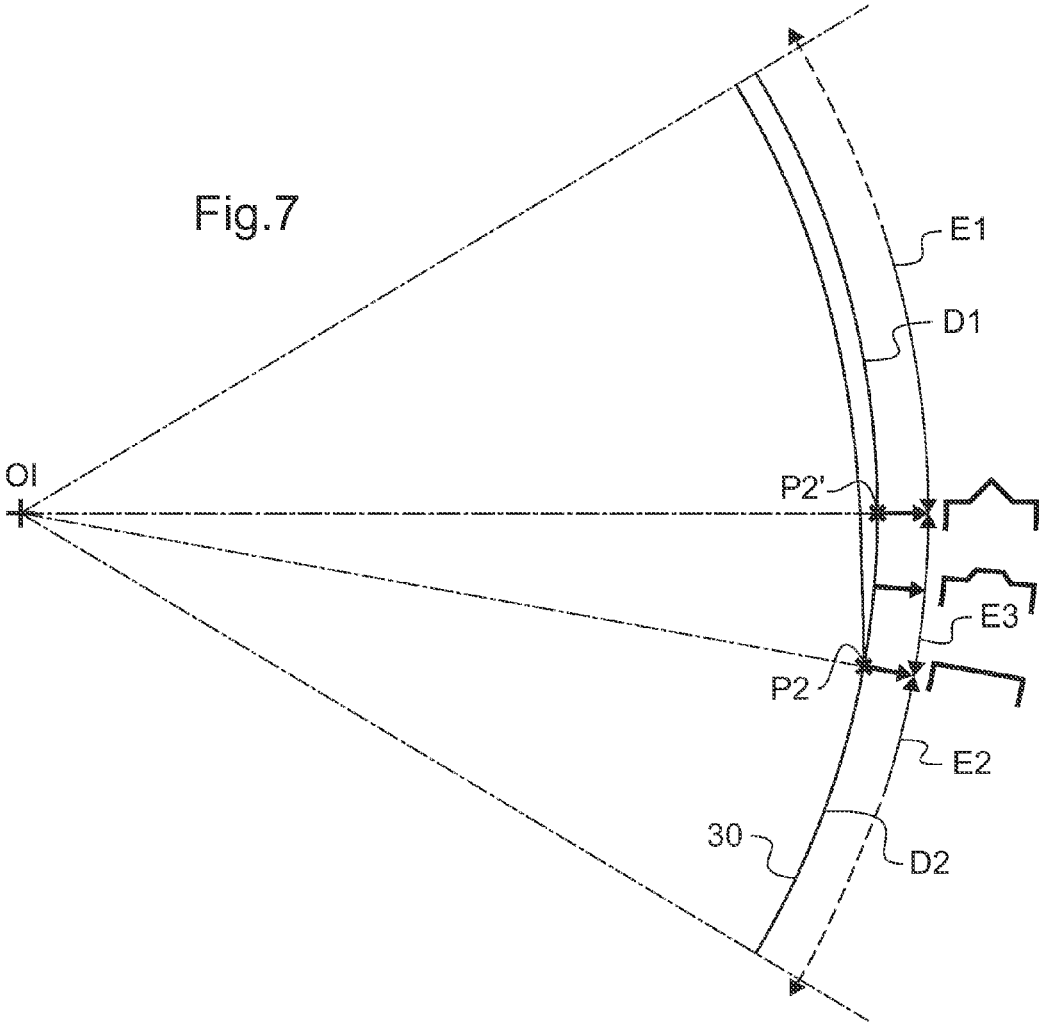
FIGS. 7 and 8 are diagrammatic plan and perspective views of the FIG. 5 ophthalmic lens, in which a portion of the outline has been leveled.
Figure 8:
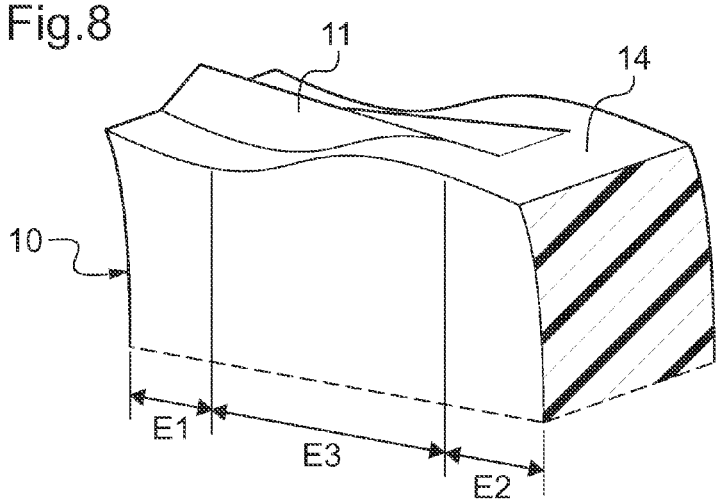

As shown in FIGS. 7 and 8, during the operation of leveling this fraction E2, E3 of the outline of the lens so as to be straight, the straight leveling grindwheel 214 is controlled relative to the ophthalmic lens 10 so that its working surface follows the longitudinal profile 30.

In this way, over the bottom portion E2 of the outline of the ophthalmic lens 10, the bevel 11 that was initially formed thereon is completely truncated so as to present a straight finish 14.

In contrast, in the link portions E3 of the outline of the ophthalmic lens 10, the bevel 11 is truncated in part only. The apex of the bevel is thus truncated progressively going from the final singular points P1' and P2' where it is left intact to the initial singular points P1 and P2 where the bevel is truncated completely.

At the end of this leveling operation, the height of the bevel 11 thus varies progressively over each of the link portions E3 of the outline of the ophthalmic lens 10.

Figure 9:
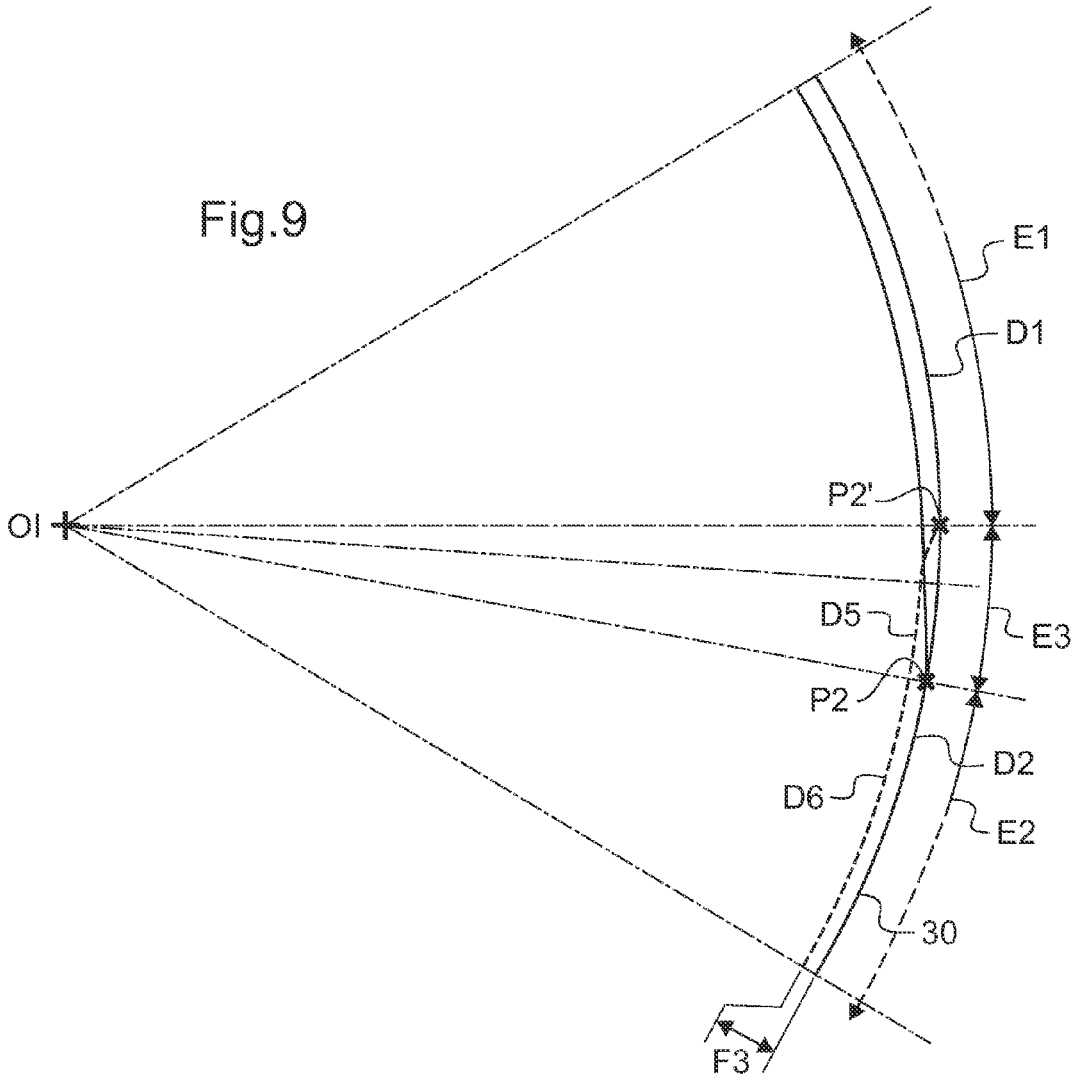
FIGS. 9 and 10 are diagrammatic plan and perspective views of the FIG. 7 ophthalmic lens, in which a portion of the outline has been grooved.

As shown in FIGS. 9 and 10, during the operation of grooving the portion E2, E3 of the outline of the lens, the grooving grindwheel 221 is controlled relative to the ophthalmic lens 10 in such a manner that over the bottom portion E2 of the outline of the lens, its working surface follows an arc D6 that is radially offset from the bottom arc D2 on the inside of the longitudinal profile 30 by an offset F3 that is constant.

The grooving grindwheel 221 is thus controlled in the bottom portion E2 of the outline of the lens in such a manner that its working surface penetrates to a desired depth F3 into the edge face of the ophthalmic lens 10.

The grooving grindwheel 221 is then controlled over the link portions E3 of the outline of the lens in such a manner that its working surface moves progressively away from the ophthalmic lens 10.

More precisely, it is controlled over each of these link portions E3 to follow an arc D5 that extends from the corresponding end of the arc D6 to the corresponding end of the final top arc D1'. In this way, the depth of the resulting groove 13 varies progressively all along each link portion E3 of the outline of the lens from a maximum depth F3 at the initial singular points P1 and P2 to zero depth at the final singular points P1' and P2'.

As shown in FIG. 10, the non-truncated portion of the bevel 11 machined on the edge face of the ophthalmic lens 10 extends over an angular sector of the outline of the ophthalmic lens that is less than the angular sector of the half-rim of the eyeglass frame 20. In this way, the bevel 11 does not appear in unsightly manner at the ends of the half-rim of the eyeglass frame 20.

The groove 13 begins under the half-rim of the eyeglass frame 20, such that the nylon thread 21A attached close to said end of the half-rim can extend directly into the groove 13 without coming into abutment against the edge face of the ophthalmic lens 10, thereby improving the appearance of the pair of glasses that is obtained in this way and also improving the rigidity with which the ophthalmic lens 10 is mounted in its surround 21.

Second Example

Consideration is now given to the selected eyeglass frame being of the third type.

As shown in FIG. 8, the first finishing step then needs to consist in an operation of beveling a first portion E1 of the outline of the ophthalmic lens 10, while the second finishing step then needs to consist in a single operation of leveling a second portion E2 of the outline of the ophthalmic lens 10.

These beveling and leveling operations may then be performed in the same manner as described above.

In a variant, provision may be made to bevel only the first portion E1 of the outline of the ophthalmic lens 10 between the two final singular points P1' and P2', and then to level the remaining portion of the outline of the ophthalmic lens 10 along the longitudinal profile 30.

Third Example

Finally, consideration is given to the selected eyeglass frame being of the first type.

Figure 11A:
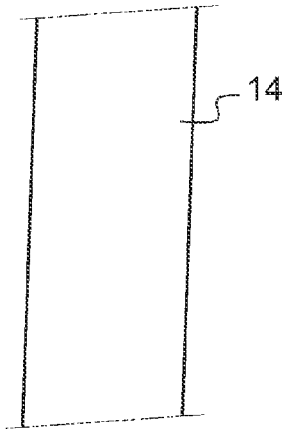
FIGS. 11A to 11C are diagrammatic plan views showing the operations for finishing the outline of a grooved ophthalmic lens with two grooves of different widths.
Figure 11B:
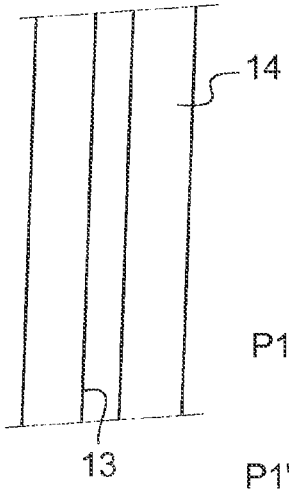
Figure 12:
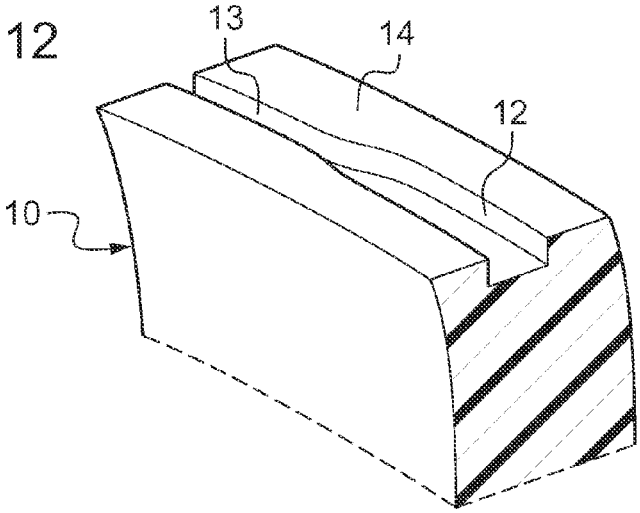
FIG. 12 is a diagrammatic perspective view of a peripheral portion of the ophthalmic lens of FIG. 11C.

As shown in FIG. 12, the first finishing step then needs to consist in a leveling operation (FIG. 11A) followed by a first grooving operation (FIG. 11B) over a first portion E1 of the outline of the ophthalmic lens 10, so as to form a first groove 13 of given width and depth.

Figure 11C:
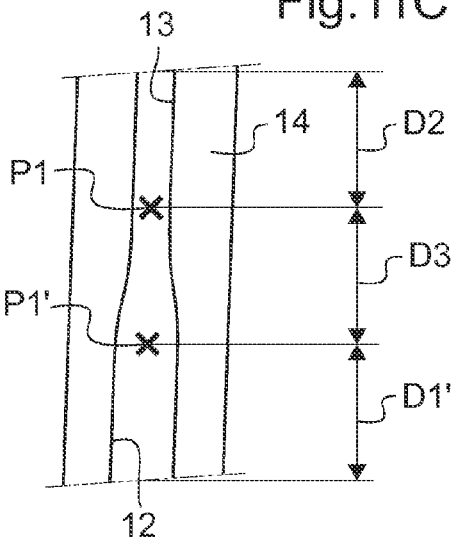

The second finishing step then needs to consist in a second grooving operation (FIG. 11C) over a second portion E2 of the outline of the ophthalmic lens 10 so as to form a second groove 12 of width and/or depth that is/are different from the width and/or depth of the first groove 13.

During the leveling operation, the entire outline of the ophthalmic lens 10 is leveled to follow the longitudinal profile 30.

During this leveling operation, the straight leveling grindwheel 214 is controlled more relative to the ophthalmic lens 10 more particularly in such a manner that its working surface follows the entire longitudinal profile 30.

During the first machining operation, the entire outline of the ophthalmic lens 10 is grooved in such a manner that the first groove 13 extends over the entire edge face of the lens.

For this purpose, the grooving grindwheel 221 is controlled relative to the ophthalmic lens 10 in such a manner that its working surface follows a profile that is radially offset from the longitudinal profile 30 by a constant value that is selected as a function of the depth desired for the first groove 13.

During the second grooving operation, the grooving grindwheel 221 is then controlled relative to the ophthalmic lens 10 in such a manner that its working surface passes once more in the portion of the first groove 13 that is situated along the final top arc D1'. In this portion, the grooving grindwheel 221 is controlled more particularly to swing from side to side so as to enlarge the first groove 13 in such a manner as to form the second groove 12.

It is also controlled to swing through a constant amplitude along the final top arc D1' so that the second groove 12 presents a width that is constant, and to swing through an amplitude that diminishes down to zero along the link arc D3 so that the junction arcs between the two grooves 12 and 13 are progressive.

In a variant, it would naturally be possible to provide for the ophthalmic lens to be grooved in such a manner that the junctions between the two grooves are abrupt so that they thus form two narrowings of section at the two final singular points P1' and P2'.

In any event, this different of widths between the two grooves thus makes it possible for each groove 12 and 13 to match the diameter of the nylon string and the width of the ridge provided along the inside face of the half-rim of the eyeglass frame.

What is claimed is:

1. A shaping method for shaping an ophthalmic lens for mounting in a mixed surround of an eyeglass frame, the method comprising:

a) a step of acquiring a longitudinal profile characterizing the shape desired for an outline of said ophthalmic lens;

b) a step of subdividing said longitudinal profile into a final first arc associated with a first segment of the mixed surround and a second arc distinct from said final first arc, in which step the positions of two initial singular points of the longitudinal profile are acquired that characterize the positions of two ends of the first segment of said mixed surround;

c) a first finishing step of finishing the ophthalmic lens, during which a first portion of its outline is brought to the shape of the final first arc; and d) a second finishing step of finishing the ophthalmic lens during which a second portion of its outline is brought to the shape of the second arc;

said first and second finishing steps being performed in such a manner that an edge face of the ophthalmic lens presents transverse profiles of shapes that are different over the first and second portions of the outline of the ophthalmic lens;

wherein, in step b), the position of at least one of the two initial singular points is corrected in such a manner as to obtain two final singular points that define said final first arc, which arc is truncated so that its length is shorter than that of an initial first arc of the longitudinal profile extending between the two initial singular points of the longitudinal profile.

2. A shaping method according to claim 1, wherein, said longitudinal profile presents a boxing center of the longitudinal profile, and the two acquired singular points are angularly spaced apart around the boxing center by an initial angle that is equal to the angle between the two ends of the first segment about the boxing center.

3. A shaping method according to claim 2, wherein the two corrected singular points are angularly spaced apart about the boxing center by a final angle that is at least 5 degrees smaller than said initial angle.

4. A shaping method according to claim 1, wherein, in step b), the position of at least one of the two acquired singular points is corrected in order to obtain the corresponding singular point by an offset calculated as a function of the shape of said longitudinal profile.

5. A shaping method according to claim 1, wherein, step c) and step d) are implemented respectively using first and second finishing tools, and in step b), the position of at least one of the two acquired singular points is corrected in order to obtain the corresponding corrected singular point by an offset that is calculated as a function of the shape of at least one of said first and second finishing tools.

6. A shaping method according to claim 1, wherein, in step b), at least one of the two acquired singular points presents a position that is corrected by a predetermined offset in order to obtain the corresponding corrected singular point.

7. A shaping method according to claim 1, wherein, in step c), the entire outline of the ophthalmic lens is machined using a first finishing tool, and, in step d), only a portion of the outline of the ophthalmic lens is machined using a second finishing tool.

8. A shaping method according to claim 1, wherein, in step c), the first portion of the outline of the ophthalmic lens is beveled using a beveling tool, and, in step d), the second portion of the outline of the ophthalmic lens is leveled using a straight leveling tool and then grooved using a grooving tool.

9. A shaping method according to claim 8, wherein, in step c), the ophthalmic lens is beveled in a link portion situated between said first and second portions of the outline of the ophthalmic lens along a link arc that extends from the final first arc of said longitudinal profile and that is offset radially outwards from the longitudinal profile.

10. A shaping method according to claim 9, wherein, said beveling tool presents a beveling groove, and said link arc is offset from said longitudinal profile by a maximum offset equal to the depth of said beveling groove.

11. A shaping method according to claim 9, wherein the bevel made in step c) is pared away and then grooved along all of said link portion of the outline of the ophthalmic lens.

12. A shaping method according to claim 1, wherein, in step c), the first portion of the outline of the ophthalmic lens is beveled using a beveling tool, and, in step d), the second portion of the outline of the ophthalmic lens is only leveled using a straight leveling tool.

13. A shaping method according to claim 12, wherein the ophthalmic lens is beveled in a link portion situated between said first and second portions of the outline of the ophthalmic lens along a link arc that extends from the final first arc of said longitudinal profile and that is offset radially to the outside of the longitudinal profile by a maximum offset that is less than or equal to the depth of a beveling groove provided in said beveling tool.

14. A shaping method according to claim 12, wherein, the second arc is complementary to the final first arc, and the ophthalmic lens is beveled over the first portion of its outline along said final first arc and is leveled over the second portion of its outline along the second arc.

15. A shaping method according to claim 1, wherein, in step c), the first portion of the outline of the ophthalmic lens is grooved so as to form a first groove, and, in step d), the second portion of the outline of the ophthalmic lens is grooved so as to form a second groove of width or depth that is different from the width or depth of said first groove.

16. A shaping method according to claim 15, wherein said first and second grooves are made using the same grooving tool.

* * * * *